US005505150A

United States Patent [19]

James et al.

[11] Patent Number: 5,505,150

[45] Date of Patent: Apr. 9, 1996

[54] METHOD AND APPARATUS FOR FACILITATING LOOP TAKE TIME ADJUSTMENT IN MULTI-NEEDLE QUILTING MACHINE

[75] Inventors: Michael James, Sunrise; James T. Frazer; David Scott, both of Coral Springs, all of Fla.

[73] Assignee: L&P Property Management Company

[21] Appl. No.: 259,505

[22] Filed: Jun. 14, 1994

[51] Int. Cl.[6] ..... D05B 11/00

[52] U.S. Cl. ..... 112/475.01; 112/117; 112/275

[58] Field of Search ..... 112/275, 117, 112/118, 119, 163, 164, 165, 166, 167, 262.1, 266.1, 475.01, 475.18, 475.19

[56] References Cited

U.S. PATENT DOCUMENTS

| | | | |
|---|---|---|---|
| 4,852,506 | 8/1989 | Salganik | 112/275 X |
| 5,088,429 | 2/1992 | Kanegae | 112/275 |
| 5,154,130 | 10/1992 | Gribetz et al. | 112/292 |

*Primary Examiner*—Peter Nerbun

*Attorney, Agent, or Firm*—Wood, Herron & Evans

[57] ABSTRACT

A multiple needle double lock chain stitch quilting machine is provided with an adjustment or calibrating system by which the positions of loopers relative to the corresponding needles of each of a plurality of sets of stitching elements of a ganged array are capable of being precisely set. A control actuator is provided by which an operator, after observing the quality of the product and stopping the machine, actuates an adjustment control system. In response to the a signal from the actuator, a motor precisely advances the stitching mechanism. A sensor monitors the stitching mechanism position, for example, by reading indicia on the needle drive shaft, and generates a position signal when the stitching mechanism precisely in the loop-take-time position of its cycle. A controller stops the motor and activates a brake in response to the position signal locking the mechanism, including the needles and loopers, in the loop-take-time position. Simultaneously, the controller disables the stitching capability of the machine and releases service door locks to allow looper and needle adjustment, which the operator may perform. When the adjustment is complete and the doors are closed, a further operation of the actuator causes the controller to lock the service access doors and enable the machine to resume stitching.

9 Claims, 3 Drawing Sheets

METHOD AND APPARATUS FOR FACILITATING LOOP TAKE TIME ADJUSTMENT IN MULTI-NEEDLE QUILTING MACHINE

The present invention relates to multiple needle chain stitch quilting machines, and particularly to methods and apparatus for making relative adjustments between corresponding needles and loopers in the multiple needle arrays of such machines.

BACKGROUND OF THE INVENTION

In sewing machines of various types, threads are applied and manipulated on opposite sides of a fabric to form one or more series of stitches. The proper formation of the stitches of each series requires the cooperative movement and precise timing of cooperating stitching elements, including primarily a needle with which other elements must be synchronized. Improper timing or movement of a stitching element can result in improperly formed or inferior stitching, and in the malfunction or breaking of the thread, the stitching elements, or other elements of the machine.

Large scale automated quilting operations are performed on large commercial quilting machines. Such machines are, for example, disclosed in Gribetz et al. U.S. Pat. No. 5,154,130. Such quilting machines simultaneously sew a plurality of patterns on a multiple layered fabric using, as illustrated and described in the Gribetz et al. patent, a double lock chain stitch applied by each of a plurality of sets of stitching elements ganged in an array. The stitching elements in each of the sets employed in a double lock chain stitch quilting machine include a needle, which applies a top thread, and a looper, which applies a bottom thread. In addition, machines of the Gribetz type include, in each of the sets of stitching elements, a retainer that serves to guide the thread during a portion of each stitching cycle.

The needle and the looper in a chain stitch forming element set move cyclically through precisely timed and coordinated motions. In each cycle, the needle penetrates the fabric, drawing a top thread through the fabric, forming a top thread loop below the fabric that extends through the fabric, down through the eye of the needle, and back to the top of the fabric. At a precise point in the needle cycle, known in the art as the "loop take time", the tip of a looper, located below the fabric, moves along side of the needle, to insert a loop of the bottom thread through the top thread loop presented by the needle. The longitudinal and transverse positions of the path of the looper relative to the needle, as well as its timing relative to the motion of the needle, affect the ability of the elements to form the stitch, the quality of the stitch, and the life of the needle, looper and other machine components.

In automated quilting machines such as the Gribetz machine referred to above, banks or ganged arrays of needles form plural stitches simultaneously by operating in synchronized movements with similarly ganged arrays of loopers. In such machines, precise adjustment of every one of the sets of stitching elements must be maintained or any one of the stitched patterns could be defectively formed, resulting in the wasting of a large amount of fabric. Failure to maintain adjustment of any one of the sets of the array can also result in a failure of components of the machine, resulting in expensive repairs and costly loss in the productivity of expensive equipment.

In the past, multiple needle quilting machines have been initially adjusted by the machine manufacturer, with needles and loopers installed in one particular array to quilt products in one particular pattern. When pattern changes are required, the addition, movement, or removal of stitching elements of the array is performed by the equipment manufacturer's customer, the quilt manufacturer. When such changes are made to the array, the new needles and loopers that are installed must be precisely adjusted.

In addition, throughout the useful life of any array of stitching elements on a quilting machine, one or more elements may come out of adjustment, resulting in decline in the quality, or loss of, a stitched pattern, and the need to stop the machine and readjust the element involved. Typically, the vertical height of the needle is prone to become misadjusted, but usually the horizontal position of the needle in the array is fixed, barring the bending of a needle. Loopers, however, are usually adjustable in two or more directions relative to the needle, and thus are more prone to come out of adjustment. In addition, other elements such as needle guards on the loopers, retainer elements, thread cutting elements and other elements used in various machines can lose adjustment, requiring interruption of the use of the machine so that adjustment can be made.

In the past, stitching element adjustment, such as loop take time adjustment, in multiple needle quilting machines has involved the process of stopping the machine, manually moving a needle drive shaft, or a mechanically equivalent element, to an adjustment position, and then adjusting the position of at least one stitching element of a set, such as a looper relative to the needle, while holding the shaft in the proper adjustment position. In multiple needle quilting machines of the Gribetz type, such adjustments have been employed in the past by stopping the machine, manually rotating a needle drive shaft to align timing marks corresponding to the loop take time position of the needle, and then making element adjustments of the looper relative to the needle while the needle is in the loop take time position. Such adjustments are checked or made for any or all elements of an array.

In the making of stitching element adjustments, particularly the adjustment of looper position and timing relative to the needle in multiple needle quilting machines, the adjustment process has been time consuming. In addition, the step of manually positioning the needle drive to the precise loop take time position has resulted in the introduction of error that results in loss of quality in the adjustment being made or in prolonging the adjustment process as the operator rechecks and readjusts the settings. With large scale multiple needle quilting operations, there is a definite need for improved methods and devices that facilitate the stitching element adjustment process, particularly by speeding up and increasing the precision of the adjustment process.

SUMMARY OF THE INVENTION

It is a primary objective of the present invention to provide a method and apparatus for facilitating the making of adjustments in the relative positions and timing of stitching elements in sewing machines, particularly in multiple needle quilting machines of the double lock chain stitch type.

It is a particular objective of the present invention to provide a method and apparatus for automating at least a portion of the loop take time adjustments of multiple needle double lock chain stitch quilting machines to increase the speed and precision of such adjustments.

According to the principles of present invention, a quilting machine, particularly of the multiple needle type having ganged arrays of needles and associated stitch forming elements, is provided with an automated system for precisely positioning and locking the needle array stitching mechanism in a loop take time position and enabling the adjustment of the relative positions of the elements at each point in the array when locked in the loop take time position.

In accordance with the preferred embodiment of the present invention, such a machine is provided with an operator selectable control in response to which the bank of needles of a multiple needle quilting machine are brought to the precise loop take time position in the stitching cycle of the stitching mechanism and securely locked in that position. In this position, the operation of the machine is disabled, thus protecting the operator and the equipment while adjustment is capable of being carried out. Once locked in the loop take time position, components of the machine are activated to enable the operator to perform loop take time adjustments, and holding the stitching elements of the array in the adjustment position while the adjustments are being carried out. The details of the preferred adjustment process, and the apparatus for performing the adjustments, are set forth in the detailed description of the drawings below. The component activation includes the automatic releases of locks on access doors and the unlocking of other machine components that the operator should be permitted to move only in the course of the adjustments. When the adjustments are completed, the operator secures the access doors and other machine components in their operating positions and reselects the control, which locks the machine components and enables the operation of the machine.

The present invention increases the precision of the stitching element adjustment process, particularly multiple needle quilting machines, and reduces the time required to make such adjustments. The invention further improves the quality of the products, reduces fabric waste, shortens machine down time and increases machine component life.

These and other objectives and advantages of the present invention will be more readily apparent from the following detailed description of the drawings of the preferred embodiment of the invention, in which:

DETAILED DESCRIPTION OF THE DRAWINGS

Figure 1:
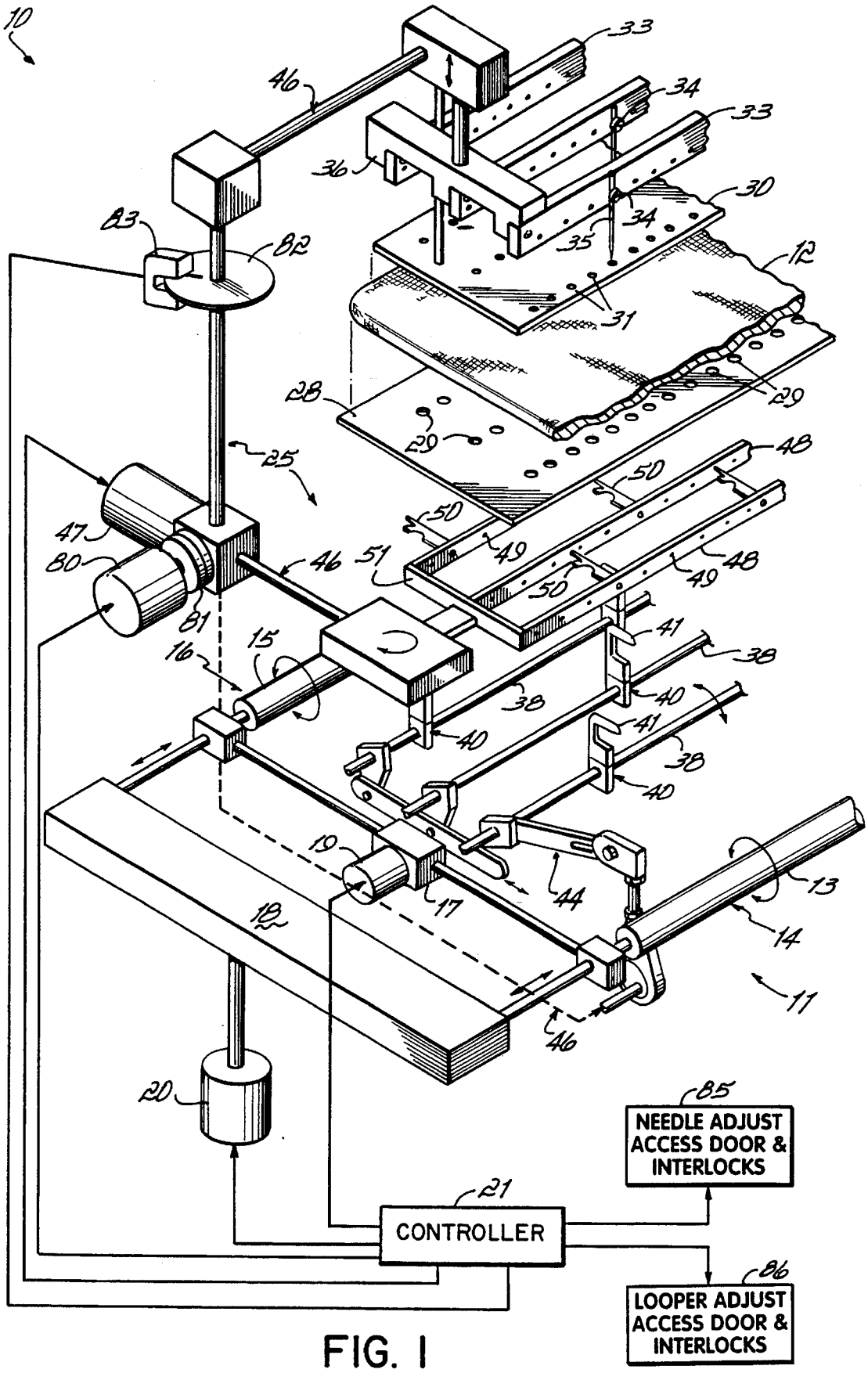
FIG. 1 is a diagrammatic disassembled perspective view illustrating the stitching element and element drive components of a multiple needle quilting apparatus.

Referring to FIG. 1, the stitching station of a double lock chain lock stitch quilting machine 10 according to one embodiment of the present invention is illustrated, showing the stitching elements and related drive linkages thereof. Such a machine is illustrated and described in greater detail in the commonly assigned U.S. Pat. No. 5,154,130 of Gribetz et al. entitled Multi-Needle Double Lock Chain Stitch Tack, Jump and Thread Trimming Quilting Method and Apparatus, hereby expressly incorporated herein by reference.

The machine 10 includes a quilting station 11 at which a stitch pattern is applied to a multiple layered fabric 12 to form a quilt. The machine 10 has two pair of transversely extending, transversely shiftable, reversible feed rollers 13 (only one shown), adjacent the entry end 14 of the quilting station 11 through which the fabric 12 passes before entry into the quilting station 11. The rollers 13 are linked through respective longitudinal and transverse drive transmissions 17 and 18 to be driven, by respective longitudinal and transverse drive motors 19 and 20, in synchronism with cooperating exit feed rollers 15 (only one shown) at the exit end 16 of the quilting station 11. The rollers 13 and 15 are driven, under the programmed control of a controller 21, so that the rollers 13 and 15 rotate or transversely shift together, to advance, reverse and transversely shift the fabric 12 as it moves through the quilting station 11 to quilt a pattern.

Figure 2:
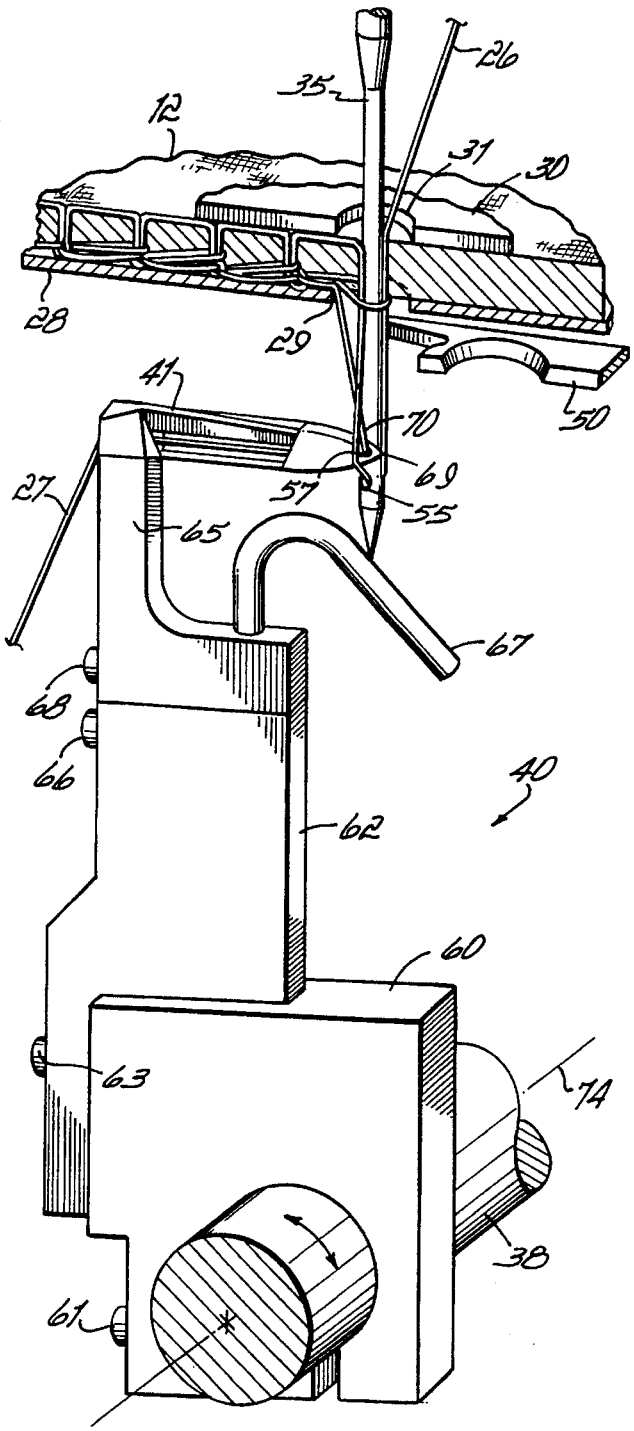
FIG. 2 is an enlarged perspective view of one set of the stitch forming elements of the multiple needle quilting apparatus of FIG. 1, including a needle, needle plate, looper and retainer, and illustrating the formation of a modified 401 double lock chain stitch, with the needle shown in the "loop take time" position.

At the quilting station 11, the fabric 12 is sewn with a stitch forming mechanism 25 into arrays of quilted patterns from a plurality of needle threads 26 and a plurality of looper threads 27 (FIG. 2). The stitching mechanism 25 of the quilting station 11 includes a plurality of stitch forming elements positioned above and below a needle plate 28. The plate 28 supports the fabric 12 as patterns are stitched. The plate 28 has a matrix of needle receiving holes 29 therein spaced approximately one inch apart in three parallel rows spaced about six inches apart. A presser plate 30, which is located above the plate 28, moves down to press the fabric 12 against the plate 28 to hold the fabric as the needle 35 is extended through it, and moves up to allow the fabric 12 to be moved. The presser plate 30 also has a matrix of holes 31 therein which correspond to the matrix of needle holes 29 in the needle plate 28.

Positioned above the rows of holes 29 of the plate 28 is a set of three parallel transversely oriented and longitudinally spaced needle support bars 33, each having a matrix of needle holders 34 thereon corresponding to, and spaced directly above, each of the holes 29 in the matrix in the needle plate 28. Each of the holders 34 includes a vertical groove in the front face of the bar 33 and a clamping screw positioned in a threaded hole beside the groove to clamp against a flat face of the shank of the needle 35 positioned in the groove to hold a needle 35 securely in position. Mounted in user selected ones of the holders 34 is an array of needles 35, so positioned to define the relative spacings of patterns. The needle bars 33 are ganged through cross members 36, mounted to reciprocate vertically at quilting station 11, to move up and down so that each of the needles 35 pass through a corresponding hole 29 in the needle plate 28.

Positioned beneath the rows of holes 29 of the plate 28 is a set of three parallel transversely oriented and longitudinally spaced looper support rods 38, each having a plurality of looper holders 40 thereon corresponding to, and spaced directly below, each of the holes 29 in the needle plate 28. Mounted to selected ones of the holders 40 is a looper 41, so positioned to correspond one to each of the needles 35, in approximately vertical alignment therewith. The looper bars 34 are pivotally mounted and linked through cross linkage assembly 44 to oscillate together in synchronism. The linkage assembly 44 is in turn linked through a transmission system 46 to oscillate in synchronism with the vertical reciprocation of the needles 35, driven by a motor 47 which operated under the control of the controller 21.

Positioned approximately 1/32" beneath the plate 28, adjacent the rows of holes 29, is a set of three parallel transversely oriented and longitudinally spaced retainer support strips 48, each having a plurality of threaded retainer mounting holes 49 thereon corresponding to, and spaced below and adjacent, each of the holes 29 in the matrix in the needle plate 28. Mounted with screws at selected ones of the holes 49 is an array of retainers 50, so positioned to correspond one to each of the needles 35 and loopers 41. The retainer strips 48 are ganged together by linkage 51 in the form of rigid bars, to move in synchronism with each other and to carry each of the retainers 50 in small circles of approximately 3/8th inch in diameter in a horizontal plane below the plate 28.

The needle bars 33, looper rods 38 and retainer strips 48 are linked together through the transmission system 46 and driven to function as part of the common stitching mechanism 25. The mechanism 25 moves cyclically so as to move the stitch forming elements, which include the needles 35, the loopers 41 and the retainers 50, in one stitch forming cycle for each cycle of the mechanism 25, thereby forming one stitch of a pattern.

FIG. 2 illustrates in detail a corresponding set of the stitch forming elements located at corresponding points adjacent a hole 29 of the plate 28. These elements include one of the needles 35, a looper 41 and a retainer 50. In FIG. 2, needle 35 is shown in the lower portion of its travel extending downward through the fabric 12 and a hole 29 in the needle plate 28, carrying one of the top threads 26 which extends through eye 55 of the needle 35 to form a top thread loop 57 below the plate 28.

The looper assembly 40 is illustrated in particular detail in this FIG. 2. It includes a looper support block 60 which clamps in position on one of the shafts 38 to which it is locked by a looper base adjusting screw 61. The angular position of the looper 41 relative to the shaft 38 and the axial position of the looper 41 on the shaft 38 are adjustable by loosening the looper adjusting screw 61, rotating the looper block 60 about or sliding the block 60 along the shaft 38, and then tightening the screw 61. To the block 60, extending generally upwardly therefrom, a looper arm 62 is rigidly connected by a looper retaining screw 63. To the top of the arm 62 is rigidly connected a looper head 65, held in place by a head retaining screw 66. A needle guard 67 is mounted on the head 65 in a vertical hole in the top thereof. The angle of the guard 67 is adjustable by rotating it in the hole and locking it in position by tightening a guard retaining screw 68 in the looper head 65.

The looper 41 itself projects in a generally horizontal direction in the forward direction from the highest point on the looper head 65. The looper 41 has a channel or hole therethrough, communicating with the forward tip 69 of the looper 41, to carry one of the looper threads 27 to form a bottom thread loop 70, which it feeds through the top thread loop 57 upon forward motion of the looper 41 caused by a forward stroke in an oscillating rocking motion of the shaft 38. In the position of the looper 41 and needle 35 illustrated in FIG. 2, the looper 41 is shown in a position during the forward portion of its travel where the tip 69 of the looper 41 has just entered the top thread loop 57 along side of the needle 35. This is the position in the stitching element cycle referred to as the "loop take time". The loop take time position is related to a precise position in the cycle of the overall stitching mechanism 25, and relates to a position of all of the linked elements of the mechanism 25. When properly adjusted, the looper tip 69 rocks from a rearward position approximately 5/32 inch behind the needle 35, through the position shown in FIG. 2, to a position ahead of the needle 35, and then back to the rearward position.

It is critically important in double lock chain stitching that there be a proper taking of the loop by the tip 69 of the looper 41 feeding the bottom thread loop 70 through the top thread loop 57. This requires precise coordination between the positions and movements of the needle 35 and the tip 69 of the looper 41 on the looper assembly 40. The proper relative positions of each looper 41 and needle 35 in the machine 1 0, when the stitching mechanism 25 is at the loop take time position, are further illustrated in FIGS. 3 and 4.

Figure 3:
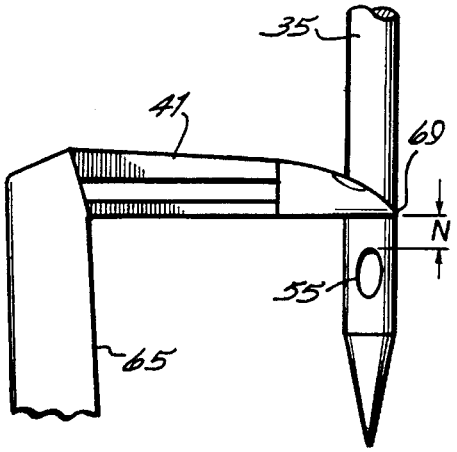
FIG. 3 is a side view of a portion of FIG. 2 illustrating the relative position of the needle and looper when properly adjusted.

Referring to FIG. 3, the tip 69 of the looper 41 is illustrated, properly adjusted but with threads 26 and 27 omitted for clarity, when at the loop take time position of the mechanism 25. In this position, the precise tip 69 of the looper 41 lies in the plane of the forward side of the needle 35, that is, the side of the needle 35 facing the front, or upstream side of the quilting station 11. Adjustment of this looper tip longitudinal position is made by loosening the base adjusting screw 61 (FIG. 2) and rotating the base 60 about axis 74 of the shaft 38, then retightening the screw 61. In addition, the vertical position of the needle 35 is illustrated in FIG. 3. This position is defined by the distance of the top of the eye 55 of the needle 35 from the bottom surface of the looper 41 at the tip 69. This adjustment is made by loosening the needle retaining screw 34 for the needle 35 (FIG. 1), sliding the needle 35 up or down as required, and then retightening the screw 34. Proper adjustment is, in the machine 10, a distance N of between approximately 1/32 and 1/16 inch.

The transverse position of the looper 41 relative to the needle 35 is also important. The proper adjusted transverse position of the looper 41 relative to the needle 35 is illustrated in the front view of FIG. 4. In its proper position in the machine 10, the looper 41 should deflect the needle 35 slightly to the left of the quilting station 11 (to the right in the front view of FIG. 4), by a distance T approximately 0.015 to 0.020 inches. This transverse adjustment is made along with the adjustment of the looper tip longitudinal position by loosening the base adjustment screw 61, sliding the block 60 to the right or left on the shaft 38, and retightening the screw 61.

Referring again to FIG. 1, the machine 10 is provided with a control and calibration system for automatically positioning locking the stitching mechanism 25, together with all of the needles 35, loopers 41, retainers 50, and interconnecting linkages and transmissions, in precisely the loop take time position relative to the position of the linkage 25. The control and calibration system includes a servo or stepper motor 80 coupled to the mechanism 25, which, when activated, either continuously or incrementally advances the mechanism 25 through a stitching cycle under the control of a signal from the controller 21. A brake assembly 81 is also provided, coupled to the mechanism 25, to lock the mechanism 25 in position under control of a signal from the controller 21. An encoder, shown as a circular encoder plate 82, is provided on a shaft of the mechanism 25 to provide a readout of the exact position of the mechanism 25 in the stitching cycle. To provide a readout of the cycle position, indicia on the plate 82 are read by an optical laser sensor 83 which sends a signal to the controller 21 of the position of the mechanism 25. The encoder 82 may be any form of accurate machine element readout device, such as any of several commercially available digital optical angular position shaft encoders that may produce several thousand output pulses per revolution of a shaft which can be converted to angular position readings by counters and other logic in the controller 21 or other computer device.

Figure 4:
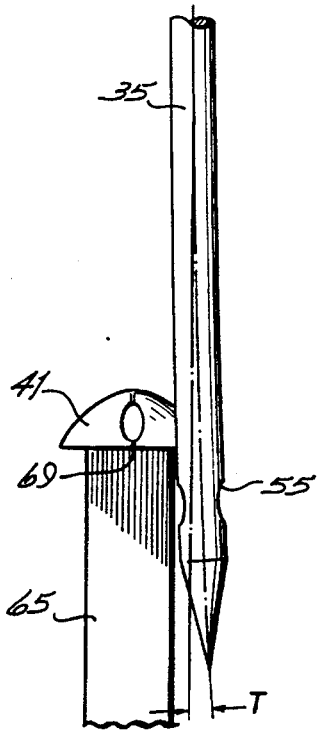
FIG. 4 is a front view of a portion of FIG. 2 illustrating the relative position of the needle and looper when properly adjusted.
Figure 5:
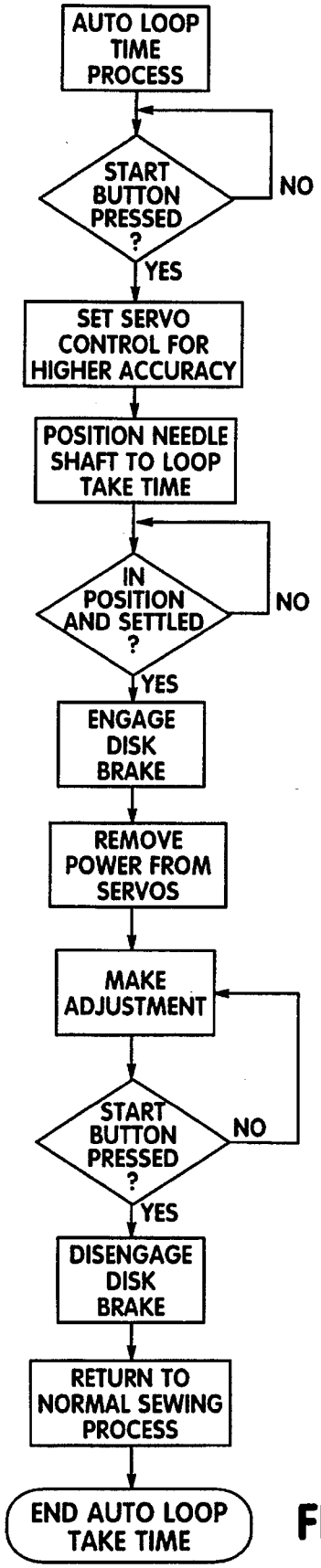
FIG. 5 is a flow chart illustrating the steps of one preferred form of the method of the present invention.

In the control and calibration system of the machine 10, the controller is programmed to receive an operator command in the form of a button press which is operative when the machine 10 has stopped to activate the motor 80 to advance the needle drive shaft and all related and linked components of the stitching mechanism 25, including needles 35, loopers 41 and retainers 50, until the sensor 83 detects from indicia on the decoder plate 82 that the mechanism is in the loop take time position. This is illustrated in the flowchart of FIG. 5, When this condition is recognized by the controller 21, the controller 21 activates the brake 81 to lock the mechanism 25 in the loop take time position, and then activates access interlocks 85 and 86 that permit the operator to make loop take time adjustments of the needles 35 and loopers 41 as described above. At the loop take time position of the mechanism 25, the needles 35 and loopers 41 will, if in precise adjustment, be in relative positions as illustrated in FIGS. 3 and 4. Otherwise, they will deviate from the illustrated positions indicating that adjustment may be required.

When the mechanism 25 has been advanced to and locked in the loop take time position and the access interlocks released, the operator performs the adjustment process, in which, for each set of stitching elements requiring adjustment, the looper assembly 40 is adjusted on the shaft 38, both longitudinally and transversely as required, and the height of the needle 35, if required, is also adjusted, When the adjustment process is completed, the operator activates a start button on a control panel sending a signal to the controller 21. Then, if the access doors are properly secured, the doors are locked and the machine 10 resumes the normal sewing operation.

The automated portions of the stitching element adjustment process and the loop take time position features of the machine 10 provide for greater precision in the maintenance of the adjustments of the quilting machine, improving the quality of the quilted products and the productivity of the production equipment.

From the above description of the preferred embodiments of the invention, it will be apparent to those skilled in the art that changes and additions to the method and apparatus can be made without departing from the principles of the present invention.

Accordingly, the following is claimed:

1. An apparatus for manufacturing quilted fabric having an array of discrete identical lock chain stitched patterns sewn therein, the apparatus comprising:

a cyclically operable stitching mechanism including corresponding pluralities of needles and loopers disposed in an array on opposite sides of a fabric to be stitched;

means responsive to an activation signal for advancing the mechanism to a predefined loop-take-time position in a stitching cycle and locking the mechanism in the loop-take-time position;

control means for conditioning the adjustment of the relative positions of each of the corresponding loopers and needles on the mechanism being in the loop-take-time position and disabling the cyclical stitching operation of the stitching mechanism when the mechanism is locked in the loop-take-time position; and means for enabling the cyclical stitching operation of the stitching mechanism in response to an operator initiated command signal.

2. The apparatus of claim 1 wherein:

the advancing and locking means includes a motor linked to the stitching mechanism and operable to advance the mechanism to a point in a stitching cycle in response to a positioning command signal and a brake operable to lock the mechanism at the loop-take-time position.

3. The apparatus of claim 1 further comprising:

a position sensor coupled to the mechanism and operable to generate a loop-take-time position signal when the mechanism is in a loop-take-time position in the cycle;

a controller programmed to generate the positioning command signal to the advancing and locking means in response to an initiating signal and to generate the braking command signal to the brake in response to the loop-take-time position signal;

an actuator operable to send an initiating signal to the controller when activated; and the advancing and locking means including motor means operative to advance the mechanism toward the loop-take-time position in response to the positioning command signal and braking means for locking the mechanism in the loop-take-time position in response to the loop-take-time position signal.

4. The apparatus of claim 1 further comprising:

the adjustment conditioning means includes access doors positioned to limit operator access to the adjusting means; and interlock means for unlocking the access doors to allow operator access to the adjustment means in response to the loop-take-time position signal.

5. An apparatus for manufacturing quilted fabric having an array of discrete identical lock chain stitched patterns sewn therein, the apparatus comprising:

a cyclically operable stitching mechanism including corresponding pluralities of needles and loopers disposed in an array on opposite sides of a fabric to be stitched;

a motor linked to the mechanism operable to advance the mechanism to a point in a stitching cycle in response to a positioning command signal;

a brake operable to lock the mechanism at the point in the cycle in response to a braking command signal;

a position sensor coupled to the mechanism and operable to generate a loop-take-time position signal when the mechanism is in a loop-take-time position in the cycle;

a controller programmed to generate the positioning command signal to the motor in response to an initiating signal and to generate the braking command signal to the brake in response to the loop-take-time position signal; and an actuator operable to send an initiating signal to the controller when activated.

6. The apparatus of claim 5 further comprising:

adjustment means for adjusting the relative positions of the stitching elements;

access doors to limit access to the adjusting means; and interlock means for unlocking the access doors to allow operator access to the adjustment means in response to the loop-take-time position signal.

7. The apparatus of claim 6 further comprising:

means for disabling the operation of the quilting machine when the enclosure means is unlocked.

8. The apparatus of claim 6 wherein:

the actuator is operable to send an enabling signal to the controller when activated; and the controller has means associated therewith for enabling the operation of the quilting machine in response to the enabling signal.

9. A method of adjusting the stitching elements of a multiple needle double lock chain stitch quilting machine, the method comprising the steps of:

providing a cyclically operable stitch forming mechanism including a plurality of mechanically linked stitch forming elements disposed on opposite sides of a fabric to be sewn and mechanically linked to move cyclically in synchronism, the each element including a needle reciprocable through the fabric from the top thereof and a looper oscillatable into and out of engagement with the needle on the bottom of the fabric;

generating an adjustment initiation signal;

providing power to a drive element and therewith advancing the mechanism in response to the adjustment initiation signal;

sensing the position of the stitching mechanism in its cycle and generating a loop-take-time position signal upon the sensing of the stitching mechanism in a loop-take-time position;

automatically stopping the drive element and locking the mechanism in the loop-take-time position in response to the loop-take-time position signal;

adjusting the positions of a looper relative to a needle of at least one of the stitching elements when the mechanism is stopped and locked in the loop-take-time position.

* * * * *